US005538180A

United States Patent [19]

Lo

[11] Patent Number: 5,538,180

[45] Date of Patent: Jul. 23, 1996

[54] PAPER CUP HAVING A COLLAPSIBLE BOTTOM

[76] Inventor: Hsin-Hsin Lo, 9, Alley 3, Lane 35, Weitao Rd., N. Dis., Taichung, Taiwan

[21] Appl. No.: 426,112

[22] Filed: Apr. 20, 1995

[51] Int. Cl.[6] ..... B65D 3/14

[52] U.S. Cl. ..... 229/405; 229/122.1; 229/238; 220/907

[58] Field of Search ..... 229/400, 405, 229/117.01, 238, 243, 244, 122.1, 4.5, 117.05, 117.06, 201; 220/666, 667, 907

[56] References Cited

U.S. PATENT DOCUMENTS

| | | | |
|---|---|---|---|
| 1,033,744 | 7/1912 | Smith | 229/117.01 X |
| 2,189,436 | 2/1940 | Rosenfield | 229/117.01 |
| 3,324,999 | 6/1967 | Farquhar | 229/243 X |
| 3,903,643 | 9/1975 | Blackmore et al. | 229/122.2 X |
| 3,921,892 | 11/1975 | Macie | 229/243 X |
| 4,119,263 | 10/1978 | Cuthbertson et al. | 229/122.2 |
| 4,125,218 | 11/1978 | DeBoer | 229/400 |
| 4,792,086 | 12/1988 | Chen | 229/400 X |
| 4,798,295 | 1/1989 | Rausing | 229/238 X |
| 5,025,981 | 6/1991 | Schellenberg | 229/400 X |

FOREIGN PATENT DOCUMENTS

| | | | |
|---|---|---|---|
| 683763 | 5/1994 | Switzerland | 229/405 |

*Primary Examiner*—Allan N. Shoap
*Assistant Examiner*—Christopher J. McDonald
*Attorney, Agent, or Firm*—Bacon & Thomas

[57] ABSTRACT

A paper cup comprises a cylindrical body having an open top and a bottom which is provided on the underside thereof with a plurality of waterproof tearing traces radiating from the center of the underside and is further provided centrally on the underside thereof with a handle fastened thereto and a large arrow indicating the direction in which the handle is pulled to bring about a total breakdown of the bottom of the paper cup. The bottom of the cylindrical body is still further provided centrally on the underside thereof with a plurality of small arrows serving to identify the area to be pressed with finger to bring about the tearing up of the bottom along the tearing traces.

1 Claim, 4 Drawing Sheets

PAPER CUP HAVING A COLLAPSIBLE BOTTOM

FIELD OF THE INVENTION

The present invention relates generally to a food or beverage container, and more particularly to a paper cup provided with a collapsible bottom to facilitate the disposal of the paper cup after it is used.

BACKGROUND OF THE INVENTION

From the standpoint of environmental protection, it is a rather desirable practice that the used paper cups are squeezed with hand to cave in so as to reduce their volume before they are thrown into the garbage can. However, such a desirable practice as described above is discouraged by the fact that the conventional paper cups are generally provided with a bottom having a tough support which can not be caused to give way easily with hand.

SUMMARY OF THE INVENTION

It is therefore the primary objective of the present invention to provide a paper cup with a collapsible bottom.

In keeping with the principle of the present invention, the foregoing objective of the present invention is attained by a paper cup comprising a cylindrical body having an open top and a bottom which is provided on the underside thereof with a plurality of radiating rows of waterproof tearing traces. Located in the vicinity of the center of the underside of the bottom are a small handle and a large arrow indicating the direction in which the small handle is pulled to cause a total breakdown of the bottom of the paper cup. The bottom of the paper cup is further provided centrally on the underside thereof with a plurality of small arrows identifying the area to be pressed with finger to bring about the tearing of the bottom of the paper cup along the tearing traces.

The foregoing objective, features, functions, and advantages of the present invention will be more readily understood upon a thoughtful deliberation of the following detailed description of a preferred embodiment of the present invention in conjunction with the accompanying drawings.

DETAILED DESCRIPTION OF THE EMBODIMENT

Figure 1:
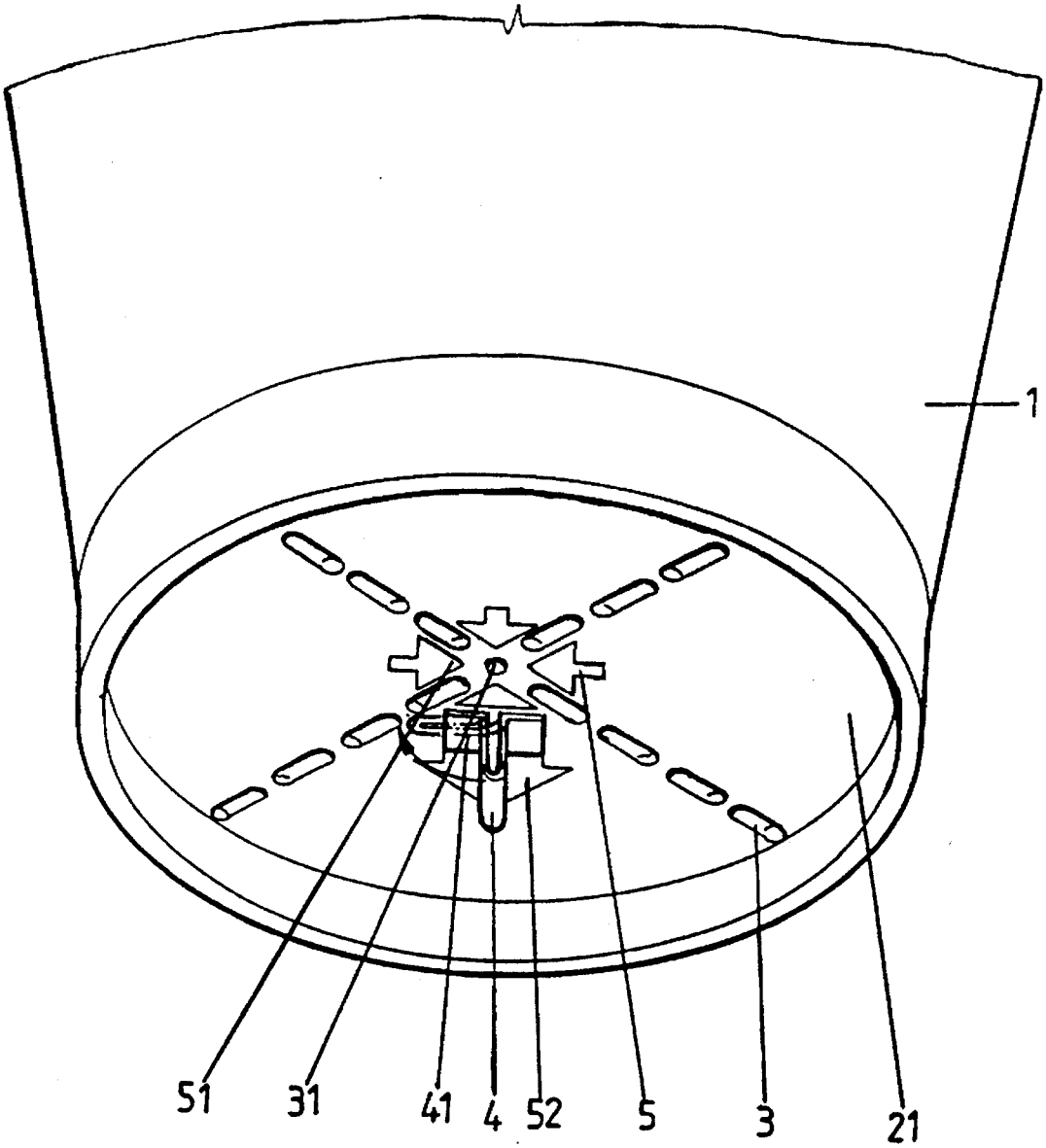
FIG. 1 shows a schematic view of the preferred embodiment of the present invention.

As shown in FIGS. 1–4, a paper cup embodied in the present invention comprises a cylindrical body 1 having an open top and a bottom 2 which is provided on an underside 21 thereof with a plurality of radiating rows of waterproof tearing traces 3. Located in the vicinity of the center of the underside 21 are a small handle 4 fastened thereto and a large arrow 52 indicating the direction in which the small handle 4 is pulled to bring about a total breakdown of the bottom 2 of the paper cup. The bottom 2 of the cylindrical body 1 of the paper cup of the present invention is further provided centrally on the underside 21 thereof with a plurality of small arrows 51 serving to identify the area which is to be pressed with finger to cause the tearing of the bottom 2 of the cylindrical body 1 of the paper cup along the tearing traces 3.

Figure 2:
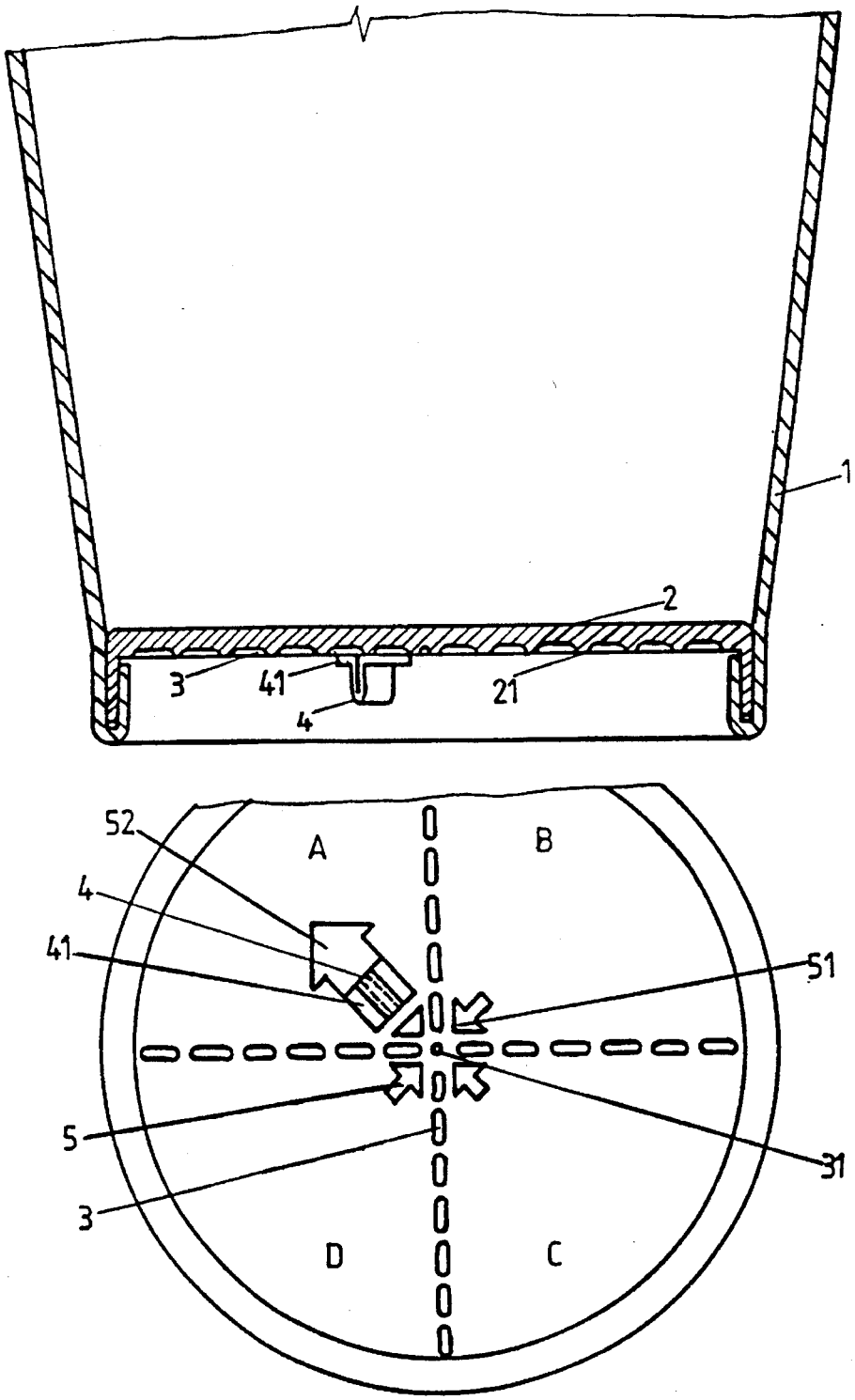
FIG. 2 shows a perspective view of the preferred embodiment of the present invention.
Figure 3:
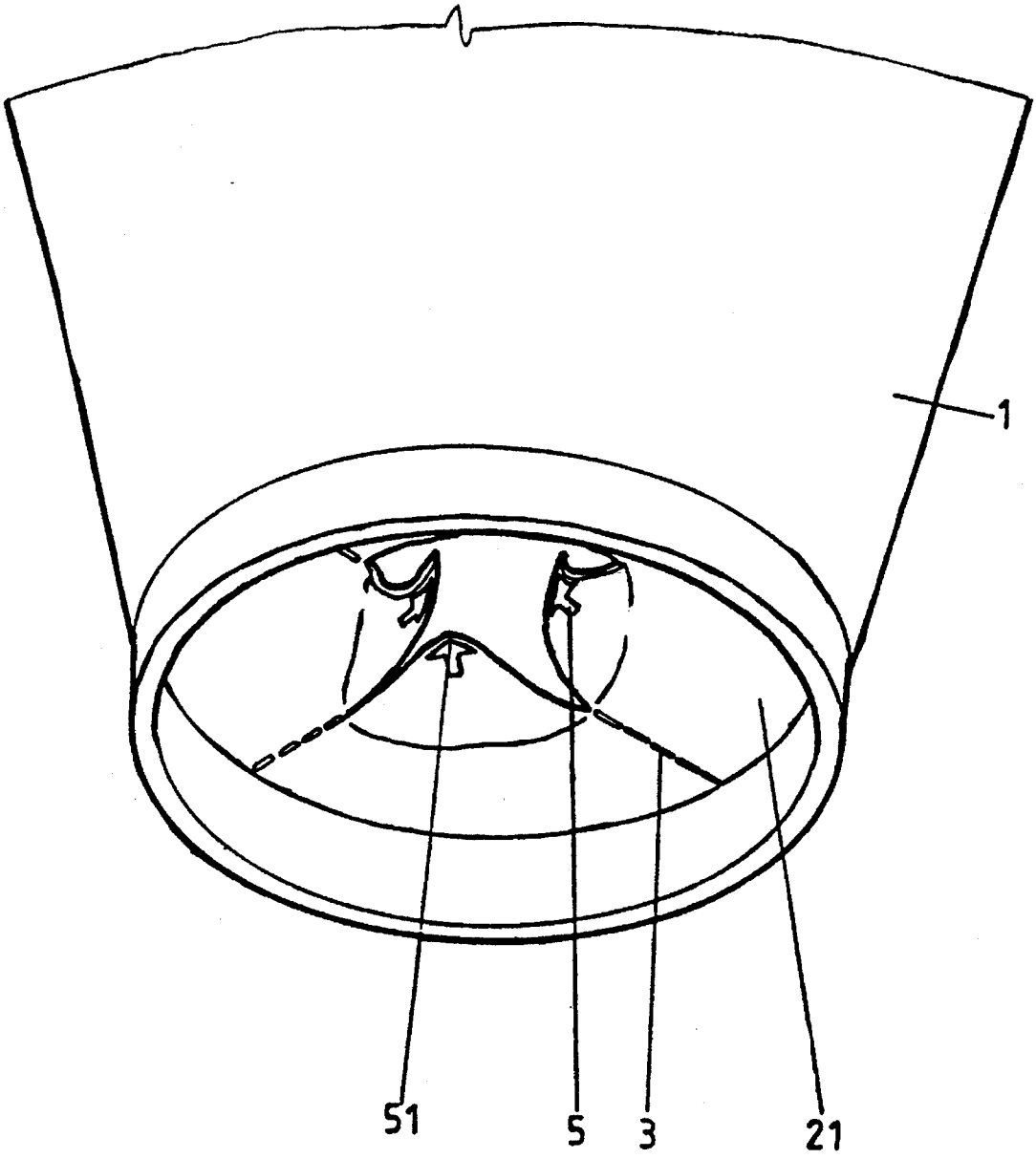
FIG. 3 shows a schematic view of the present invention at work.
Figure 4:
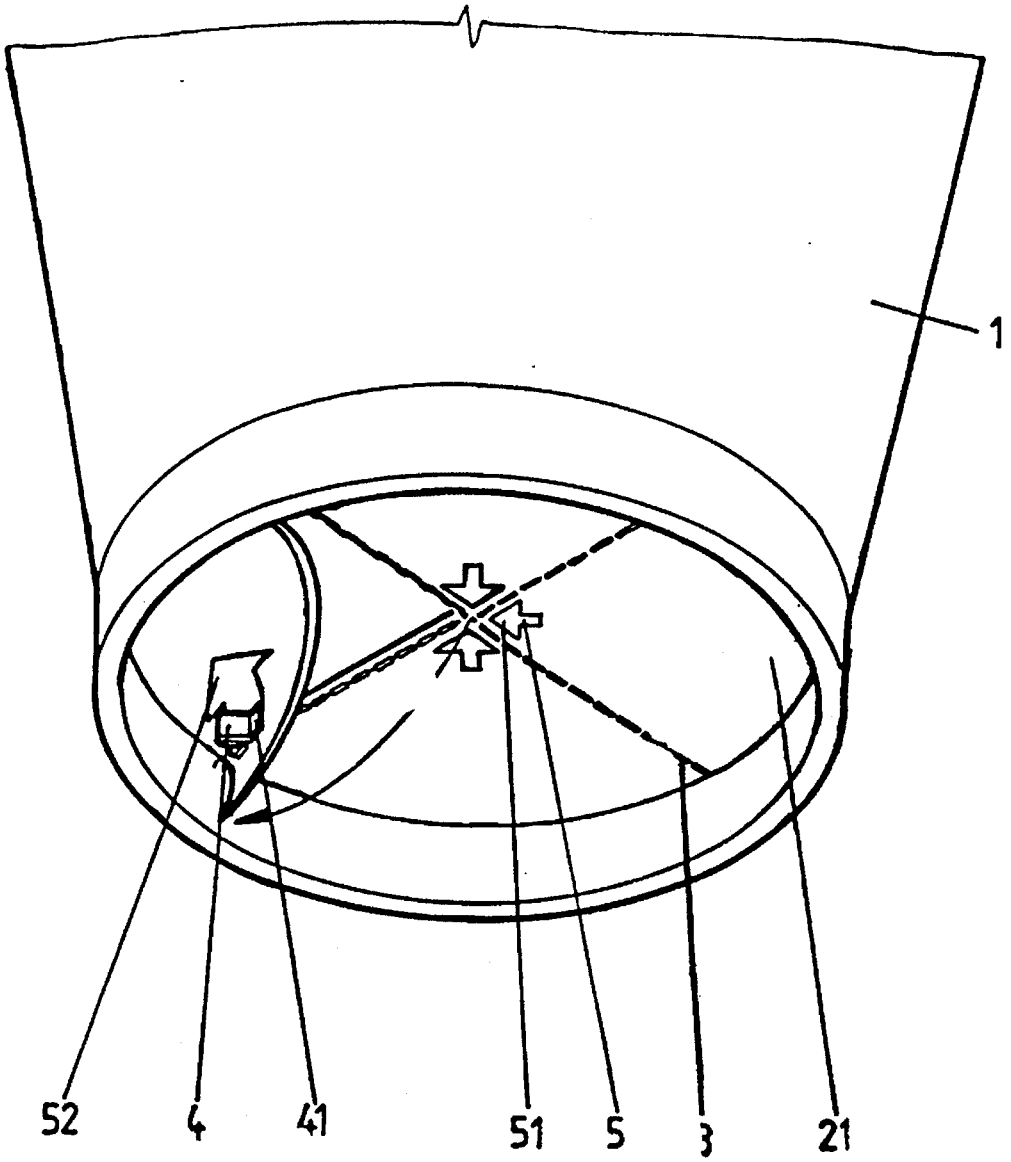
FIG. 4 shows another schematic view of the present invention at work.

As shown in FIG. 2, the underside 21 of the bottom 2 of the paper cup of the present invention is divided by the tearing traces 3 into four sectors, A, B, C and D. The small handle 4 has a bottom end 41 which is located securely near a center 31 from which the tearing traces 3 radiate. The large arrow 52 is intended to indicate the direction in which the small handle 4 is pulled to bring about a total breakdown of the bottom 2 of the cylindrical body 1, as shown in FIG. 3. The sectors B, C and D are provided respectively with a small arrow 51 serving to identify the area which is to be pressed with finger to bring about the tearing along the tearing traces 3, as shown in FIG. 4. The bottom 2 of the cylindrical body 1 of the paper cup of the present invention can be therefore torn up easily by pressing with finger the area which is pointed at by the small arrows 51.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. A paper cup comprising a cylindrical body having an open top and a bottom which is provided on an underside thereof with a plurality of waterproof tearing traces radiating from a center of said underside and is further provided on said underside thereof with a handle fastened thereto near said center of said underside, and with a large arrow indicating a direction in which said handle is so pulled as to cause a total breakdown of said bottom of said cylindrical body, said bottom still further provided centrally on said underside thereof with a plurality of small arrows serving to identify an area which can be pressed with a finger to bring about the tearing up of said bottom along said tearing traces.

* * * * *